US005898646A

United States Patent [19]

Kasaya et al.

[11] Patent Number: 5,898,646

[45] **Date of Patent: *Apr. 27, 1999**

[54] WATCH WITH EXTENDED DIAL

[75] Inventors: Masahiro Kasaya; Yasuo Kitajima; Takayuki Hasumi, all of Tanashi, Japan

[73] Assignee: Citizen Watch Co., Ltd., Tokyo, Japan

[ * ] Notice: This patent is subject to a terminal disclaimer.

[21] Appl. No.: 08/729,243

[22] Filed: Oct. 9, 1996

Related U.S. Application Data

[63] Continuation-in-part of application No. 08/350,079, Nov. 29, 1994, Pat. No. 5,592,443.

[30] Foreign Application Priority Data

| | | | |
|---|---|---|---|
| Nov. 30, 1993 | [JP] | Japan | 5-64002 U |
| Dec. 22, 1993 | [JP] | Japan | 5-325200 |
| Jun. 21, 1994 | [JP] | Japan | 6-138742 |

[51] Int. Cl.[6] ..... G04B 37/00

[52] U.S. Cl. ..... 368/281; 368/232

[58] Field of Search ..... 368/281, 282, 368/276, 294–296, 228, 232, 222

[56] References Cited

U.S. PATENT DOCUMENTS

| | | | |
|---|---|---|---|
| 3,473,319 | 10/1969 | Glass | 368/294 |
| 3,952,499 | 4/1976 | Reisman | 368/276 |
| 4,853,910 | 8/1989 | Mock | 368/300 |
| 5,036,502 | 7/1991 | Grosjean | 368/286 |
| 5,592,443 | 1/1997 | Kasaya et al. | 368/281 |

FOREIGN PATENT DOCUMENTS

| | | | |
|---|---|---|---|
| 0101663 | 2/1984 | European Pat. Off. | 368/276 |
| 2648923 | 12/1990 | France | 368/281 |
| 094011793 | 5/1994 | WIPO | 368/276 |

*Primary Examiner*—Bernard Roskoski
*Attorney, Agent, or Firm*—Dennison, Meserole, Pollack & Scheiner

[57] ABSTRACT

A watch has a watch case and a module mounted in the watch case. A dial of the watch is welded to the watch case, and a shield is also welded to the dial for shielding the dial.

8 Claims, 11 Drawing Sheets

WATCH WITH EXTENDED DIAL

This is a continuation-in-part of Application Ser. No. 08/350,079, filed Nov. 29, 1994 now U.S. Pat. No 5,592, 443.

BACKGROUND OF THE INVENTION

The present invention relates to a structure of a watch including a watch case, a dial and a shield glass.

Recently, a wrist watch with a plurality of functions and sensors becomes popular. Furthermore, various types of amusing watches are made. For example, a picture of a mascot of the Japan Professional Football League (J-League) is printed on a dial of a wrist watch. In order to enhance the amusement of the amusing watch, the watch case itself is shaped to match the picture on the dial.

FIG. 13 shows a conventional amusing watch. The watch has a cylindrical watch case 1 made of plastic and having a radially extending outer flange portion 1*a*, an upper recess 1*b*, and a band connecting portion 1*d*. A dial 2 is mounted in the watch case 1 at a lower portion of the recess 1*b*. A module 3 is mounted in the watch case 1 and an inner frame 4 is provided for supporting the module 3 in the watch case. A back 5 is secured to the watch case 1 interposing a packing 1*c*. A shield 6 is mounted on the upper recess 1*b* of the watch case 1. A crown 7 is operatively connected to the module 3. An hour hand 10, minute hand 11 and second hand 12 are secured to hand shafts 13 operatively connected to the module 3.

In the watch, the dial 2 has an amusing picture printed thereon and the outer flange portion 1*a* of the watch case 1 has a picture printed thereon, or a certain peripheral shape projected from the circumference of the shield 6, corresponding to the picture of the dial.

In order to assemble the watch, the dial 2 is secured to the watch case 1. The module 3 is mounted in the watch case 1 and supported by the inner frame 4. The back 5 is secured to the watch case 1 interposing the packing 1*c*. Then, the watch case is inverted, and the hands 10, 11 and 12 are securely mounted on the respective shafts 13. The shield 6 is secured to the upper recess 1*b* of the watch case 1.

In such a watch, the contour of the outer flange portion 1*a* is shaped for enhancing the amusing feeling relative to the picture on the dial 2. Therefore, it is necessary to provide various types of molding dies for the watch case 1 for increasing design variations. As a result, the manufacturing cost for a molding die increases.

Since the outer flange portion 1*a* of the watch case 1 and the dial 2 are separated from each other, it is difficult to print a continuous picture on the dial and the flange portion.

In addition, the crown 7 is projected from the underside of the outer flange portion 1*a*, so that the appearance of the watch is deteriorated. Furthermore, it is necessary to form a groove in the watch case 1 for receiving the packing 1*c* which causes the structure of the watch to further complicate and the number of parts to increase.

SUMMARY OF THE INVENTION

An object of the present invention is to provide a structure of a watch which may reduce manufacturing cost and has a simple watertight means.

According to the present invention, there is provided a structure of a watch comprising a watch case, a module mounted in the watch case, a dial welded to the watch case, and a shield welded to the dial for shielding the dial.

The present invention further provides a structure of a watch comprising a watch case, a module mounted in the watch case, a dial welded to the watch case, and a shield welded to the watch case at a plurality of portions each of which passes through a hole formed in the dial.

These and other objects and features of the present invention will become more apparent from the following detailed description with reference to the accompanying drawings.

DETAILED DESCRIPTION OF THE PREFERRED EMBODIMENTS

Figure 1:
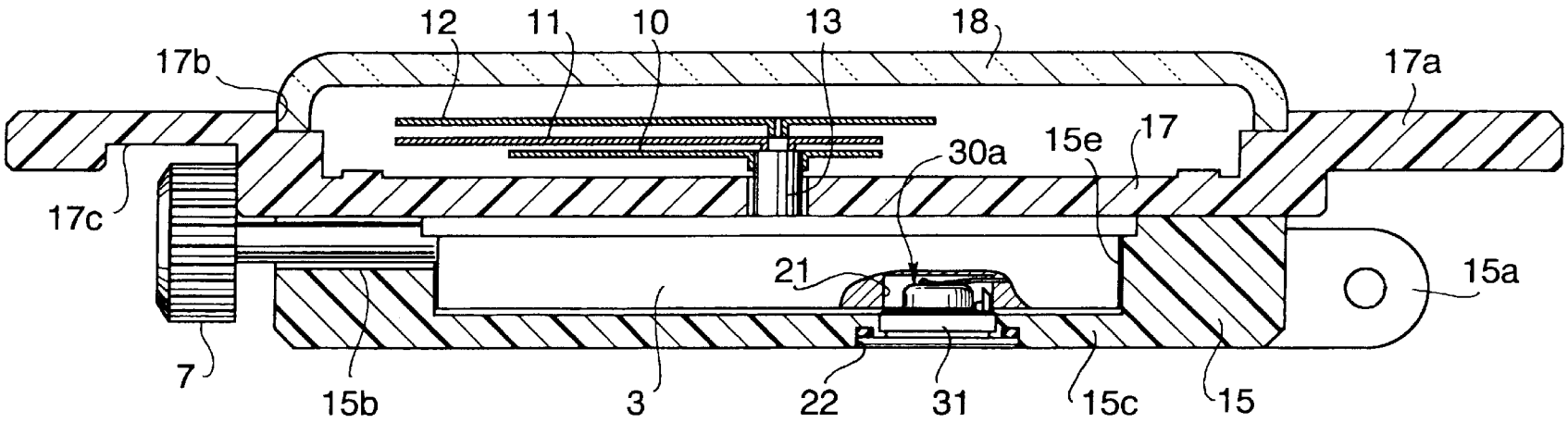
FIG. 1 is a sectional view showing a watch of the present invention.
Figure 13:
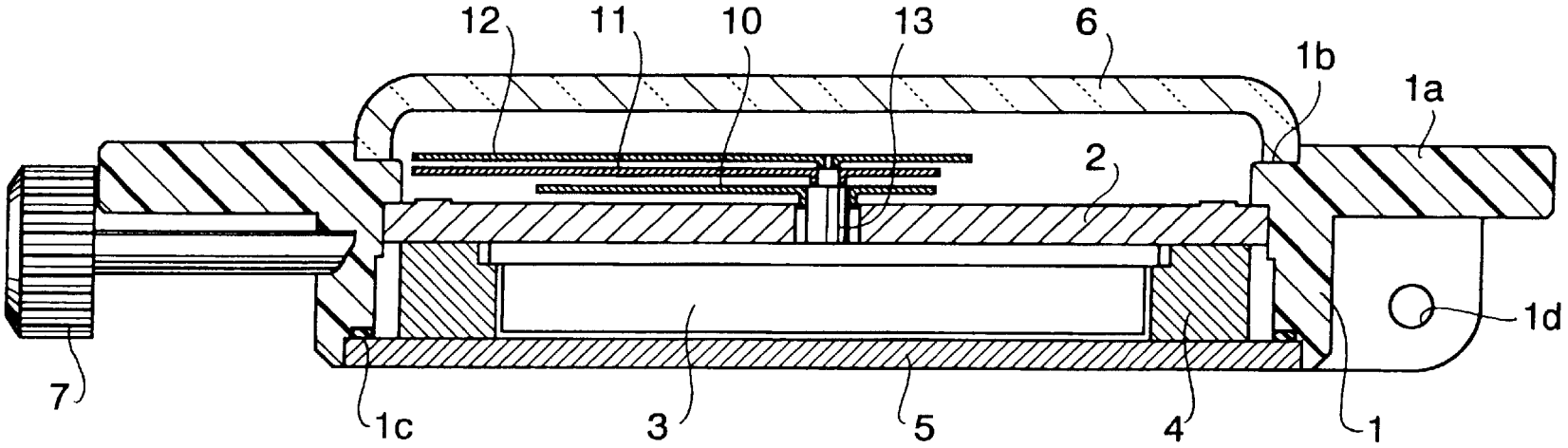
FIG. 13 PRIOR ART
FIG. 13 is a sectional view showing a conventional watch.

Referring to FIG. 1 showing an amusing watch according to the present invention, parts which are the same as the conventional watches are identified with the same reference numerals as FIG. 13.

The watch comprises a watch case 15 has an inner recess 15*e* in which the module 3 is mounted, formed in the watch case. A dial 17 is mounted on the watch case 15 and the module 3. The dial 17 has an outer extending portion 17*a* radially and outwardly extending from the watch case 15, an upper recess 17*b*, and an underside recess 17*c* formed on the underside of the outer extending portion 17*a*. The crown 7 operatively connected to the module 3 passing through a hole 15*b* is disposed in the underside recess 17*c*, so that the crown 17 is concealed by the extending portion 17*a*. A shield 18 is mounted on the upper recess 17*b* of the dial 17 and secured thereto. A pair of band connecting portions 15*a* are provided on one of the sides of the watch case 15, band connecting portions on the other side are not shown.

The watch case 15, dial 17 and shield 18 are made of ABS resin.

A battery 30*a* is mounted in a cylindrical battery chamber 21 formed in the module 3 for driving the module. A bottom 15*c* of the watch case 15 has a cylindrical opening 22 formed for communication with the chamber 21. A battery cover 31 is detachably engaged with the opening 22. A structure for holding the battery will be described hereinafter.

Figure 2:
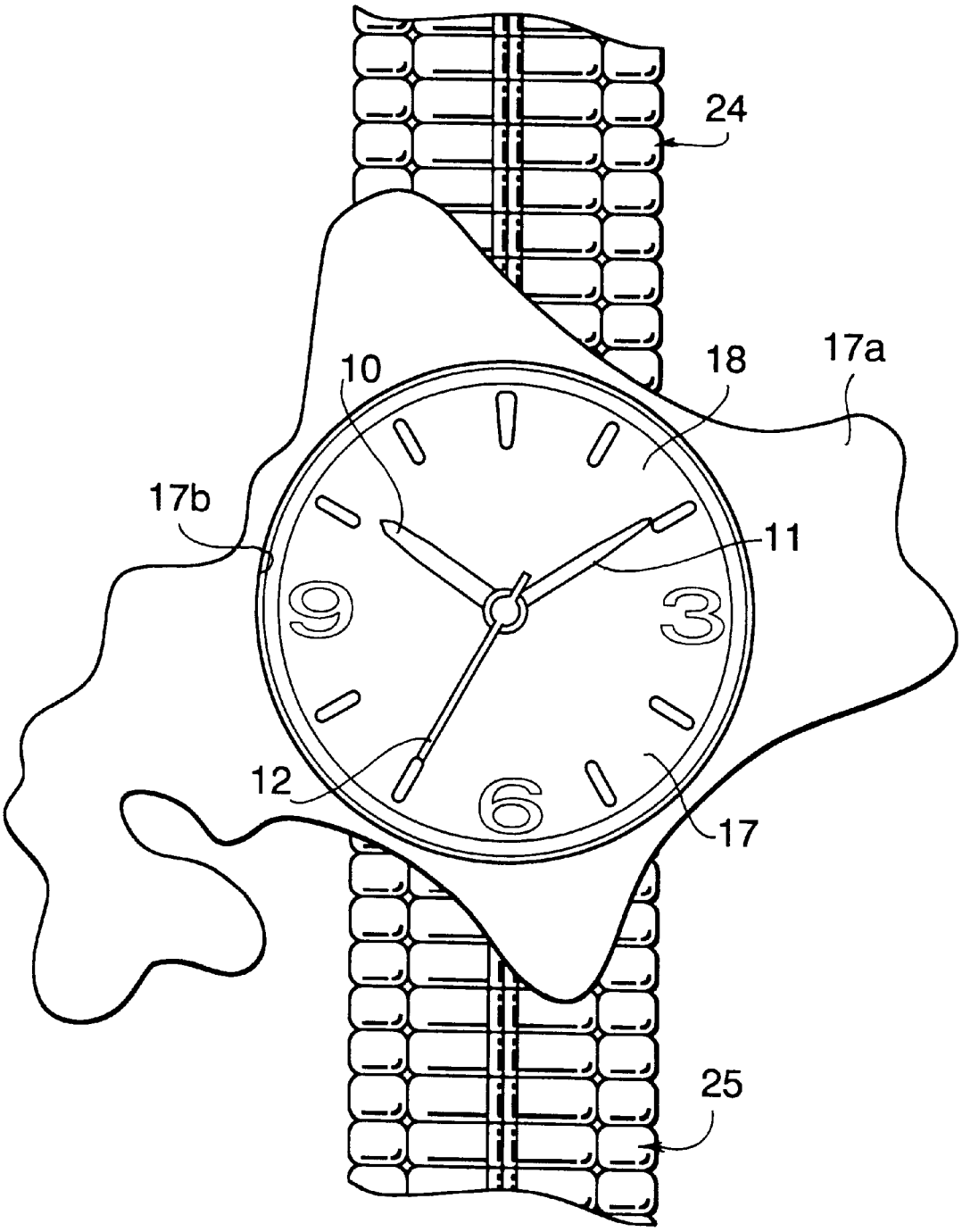
FIG. 2 is a plan view showing the watch of the present invention.
Figure 3:
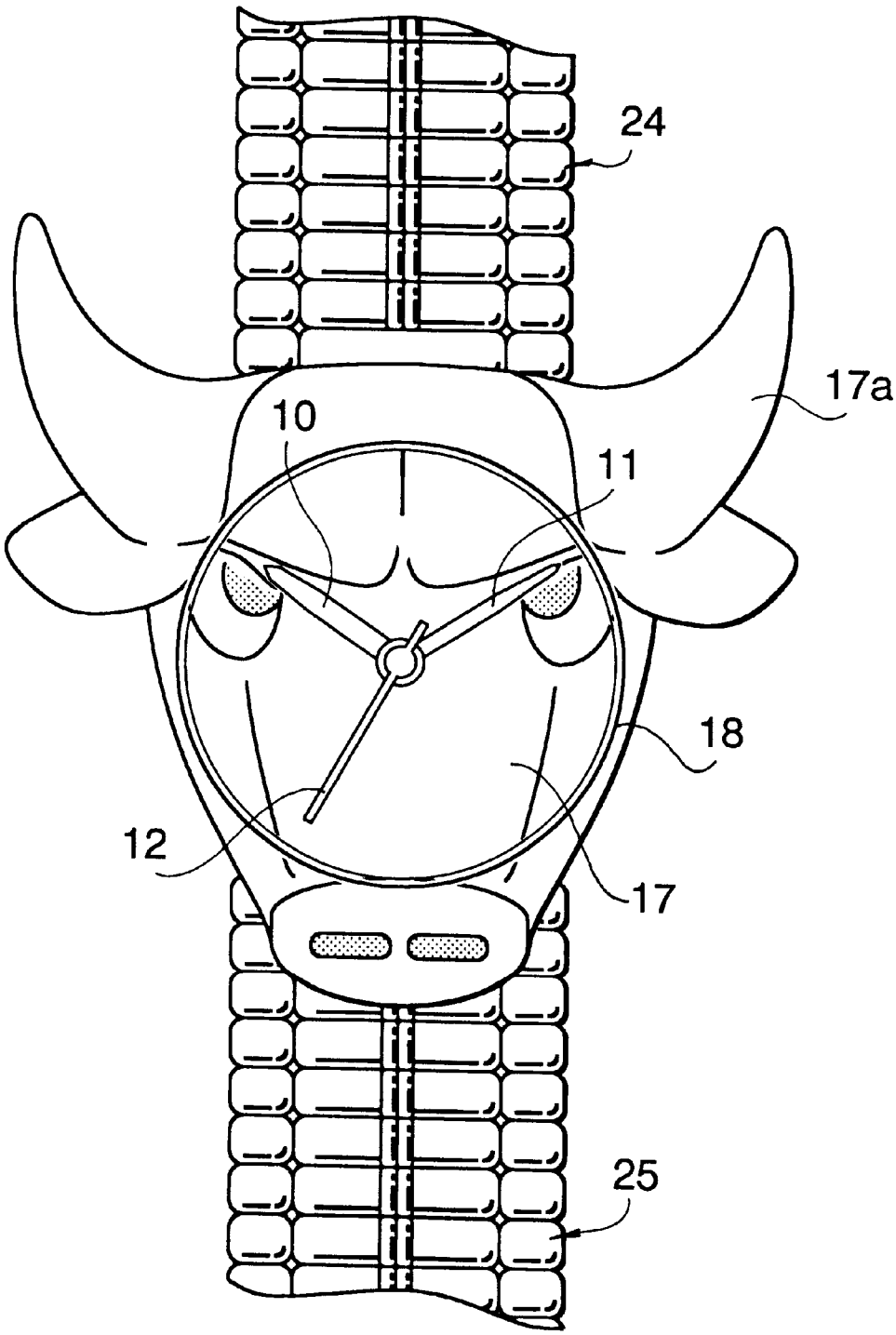
FIG. 3 is a plan view showing another design of the watch of the present invention.
Figure 4:
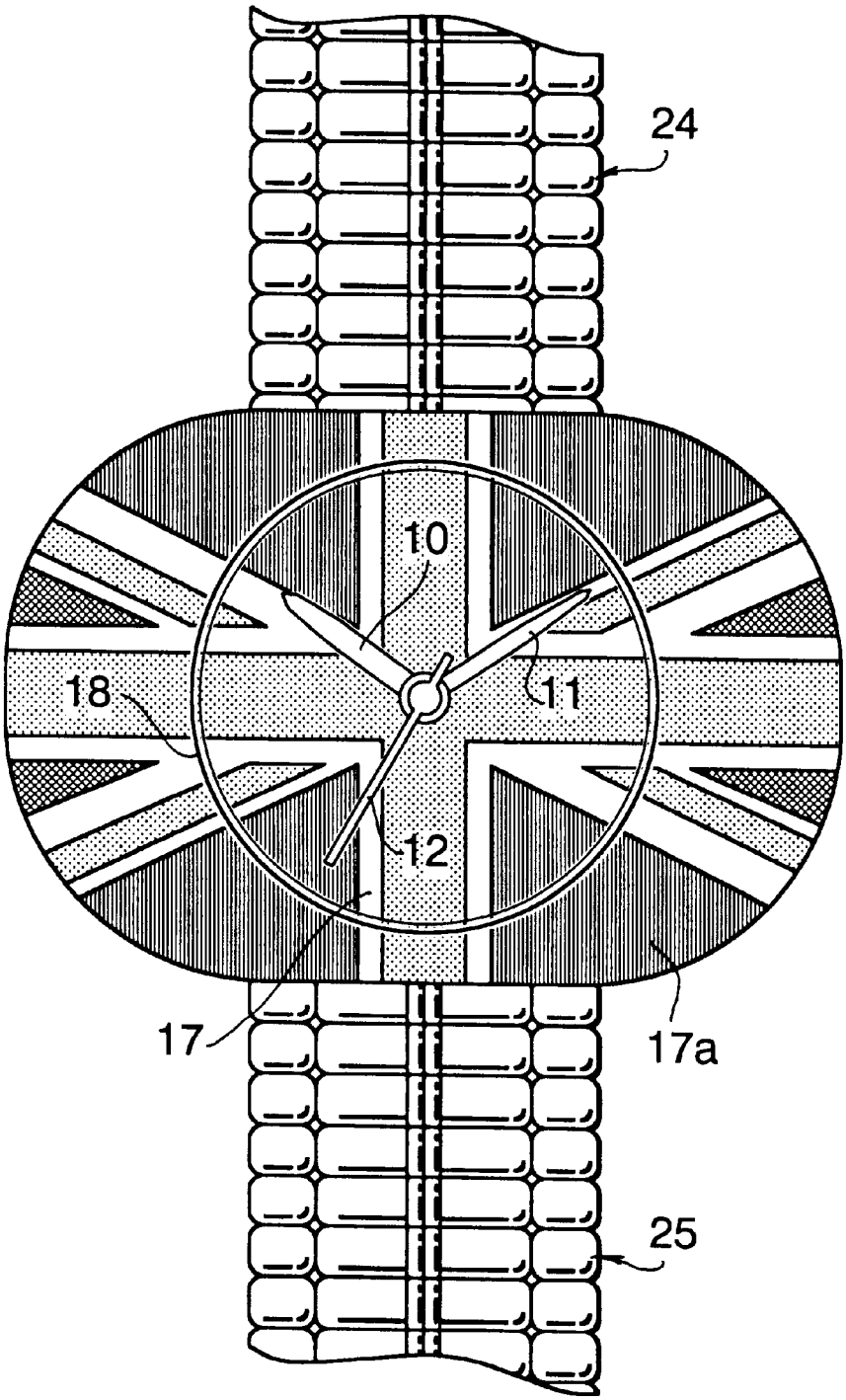
FIG. 4 is a plan view showing a further design of the watch of the present invention.

FIGS. 2 to 4 show examples of amusing watches. The dial 17 has a picture, and the outer extending portion 17*a* has a shape and a continuous pattern of the picture on the dial, thereby representing a particular meanings. The watch case (not shown) is connected to watch bands 24 and 25.

As shown in FIG. 2, the outer extending portion 17*a* has a configuration of the land of Hokkaido. The land of Hokkaido is selected as a particular shape of the land, but other various lands can be employed for the extending portion.

FIG. 3 shows the extending portion 17*a* having a configuration of a face of a bull. A part of the face is printed on the dial 17. Other animals and birds can also be printed.

FIG. 4 shows a further example representing the union Jack. Of course, other flags can be printed.

Figure 5:
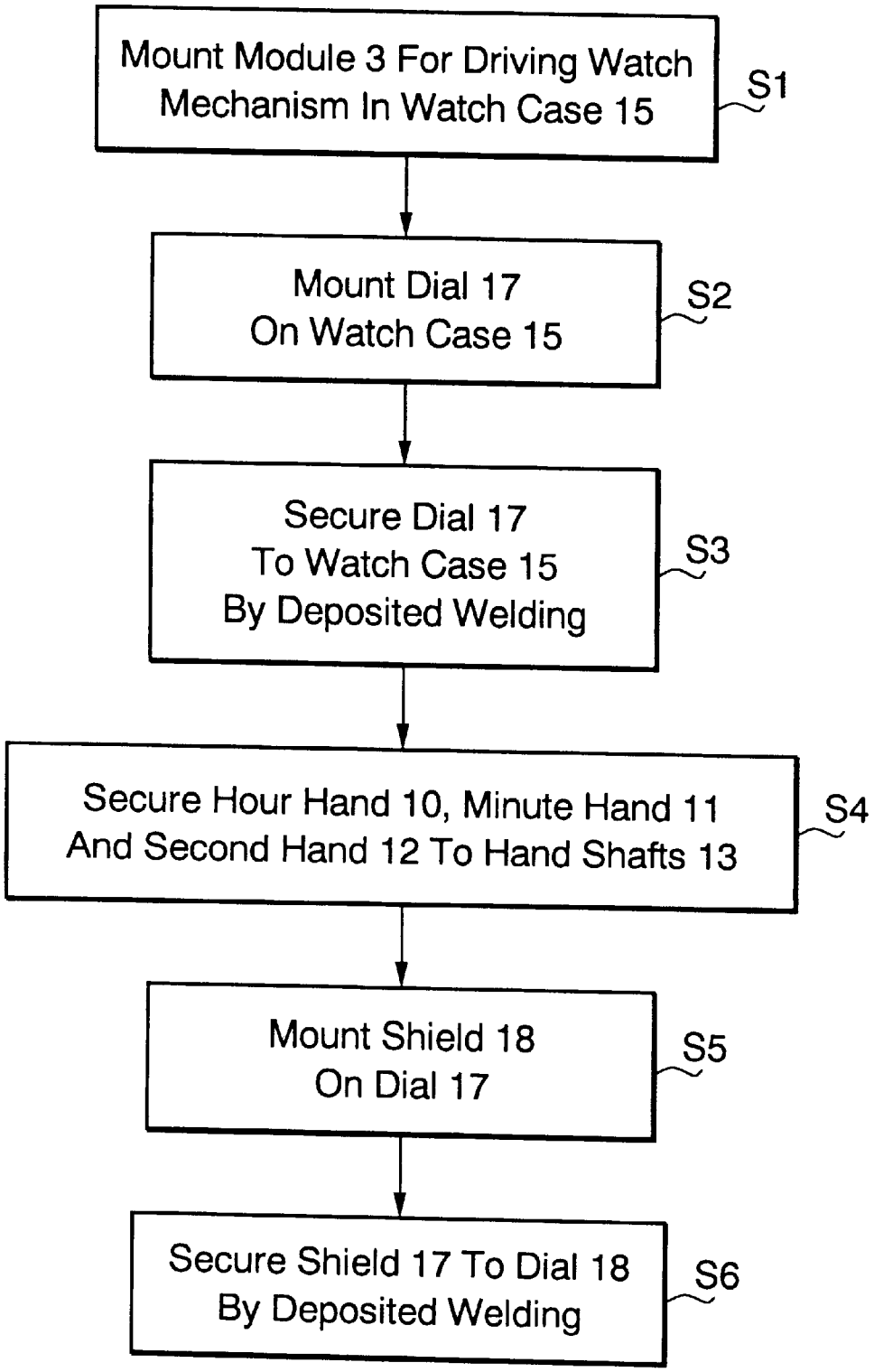
FIG. 5 is a flowchart showing a method for assembling of the watch.

The assembling of the watch will be described with reference to the flowchart of FIG. 5.

At a step S1, the module 3 is mounted in the watch case 15. At a step S2, the dial 17 is mounted on the watch case 15 and the module 3. At a step S3, the dial 17 is secured to the watch case 15 by deposited welding. At a step S4, the hands 10, 11 and 12 are secured to the hand shafts 13. At a step S5, the shield 18 is mounted on the dial 17. At a step S6, the shield is secured to the dial by deposited welding.

Figure 6:
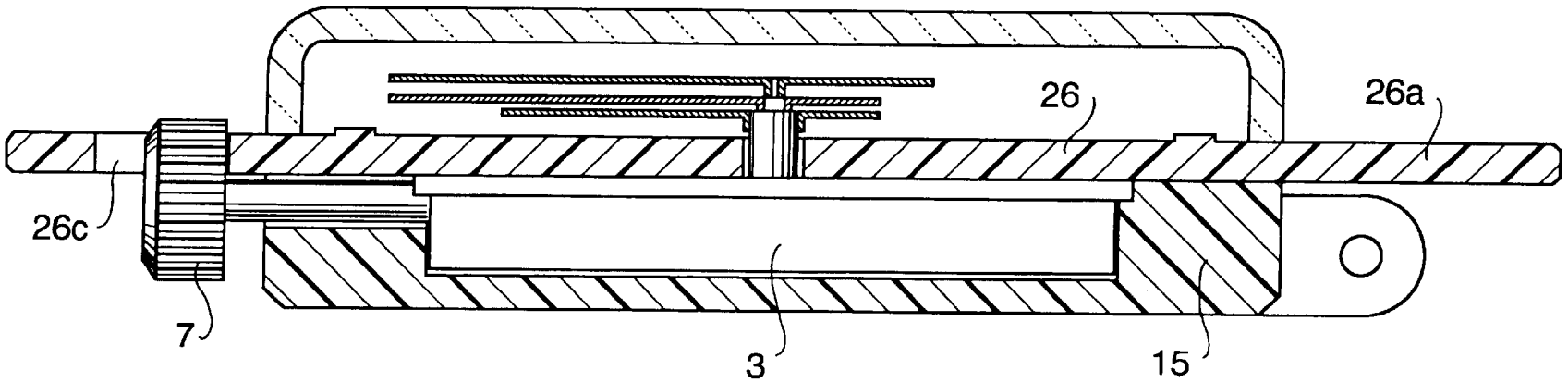
FIG. 6 is a sectional view showing a second embodiment of the present invention.

FIG. 6 shows a second embodiment where a dial 26 has an outer extending portion 26*a* a surface of which is flush with the dial 26. A notch 26*c* is formed in the outer extending portion 26*a* corresponding to the crown 7. Thus, a part of the crown 7 is inserted in the notch 26*c*.

Other structures are the same as the first embodiment, and the same parts thereof are identified with the same reference numerals as in FIG. 1.

The watch is assembled in the same manner as in the first embodiment.

Figure 7:
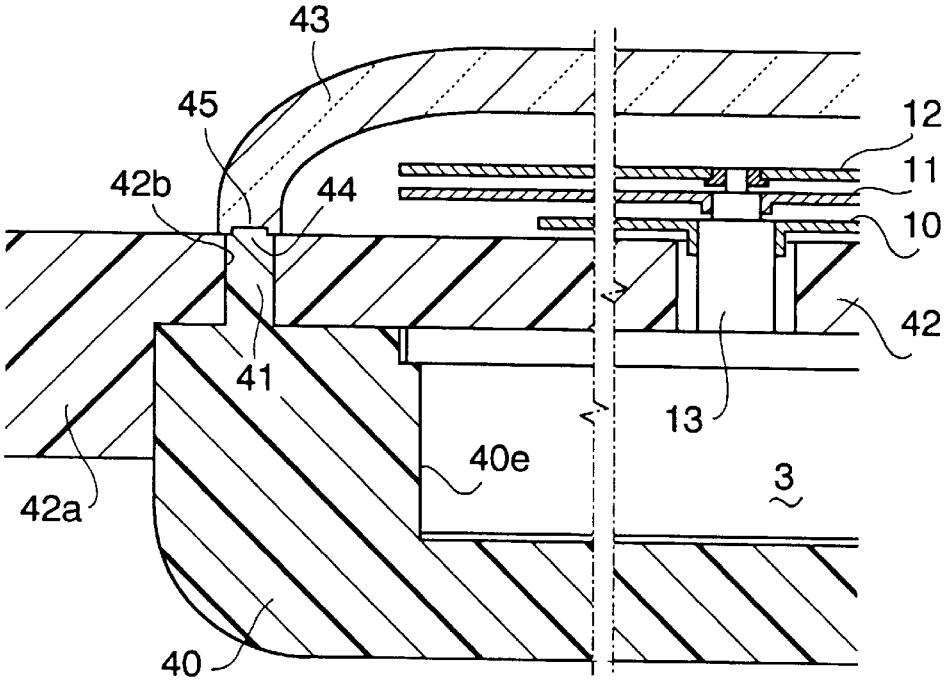
FIG. 7 is a sectional view showing a third embodiment of the present invention.

FIG. 7 shows a third embodiment of the present invention. Structures which are the same as the previous embodiments are identified with the same reference numerals as in FIG. 1.

A watch case 40 has a plurality of positioning projections 41 and a recess 40*e* for the module 3. On an upper portion of the projection 41, a melting portion 44 is provided. A dial 42 has an outer extending portion 42*a* an upper surface of which is flush with that of the dial 42. A plurality of positioning perforations 42*b* are provided for deposited welding, corresponding to the positioning projections 41 of the watch case 40. The outer extending portion 42*a* has a thickness larger than the dial 42. A shield 43 is mounted on the dial 42 corresponding to the positioning perforations 42*b*. A groove 45 is provided on a periphery of the shield 43 corresponding to the melting portion 44 of the projection 41.

Figure 8:
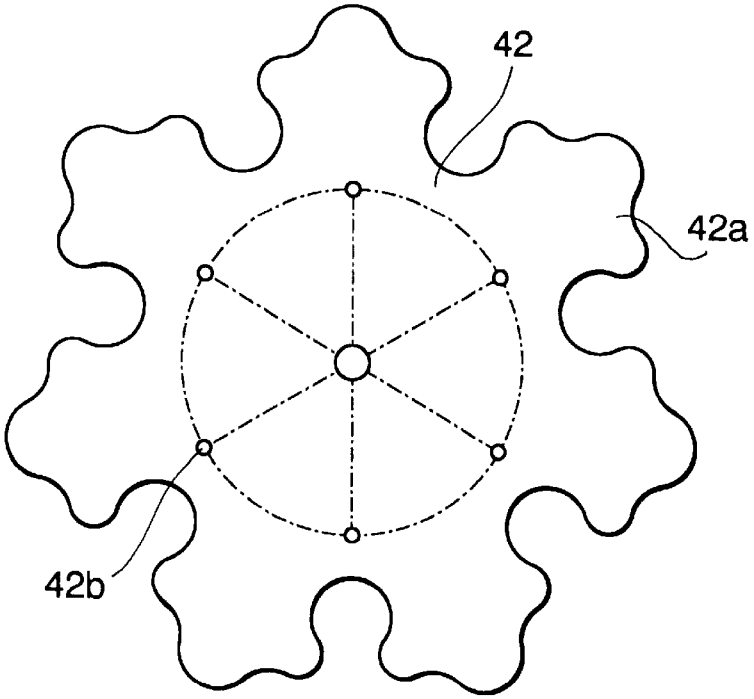
FIG. 8 is a plan view of a dial of the third embodiment.

FIG. 8 shows the dial 42. The outer extending portion 42*a* has a shape for the amusing watch. The shape is changeable to various designs to increase additional value of the watch. The positioning perforations 42*b* are provided on the circumference of the dial 42.

Figure 9:
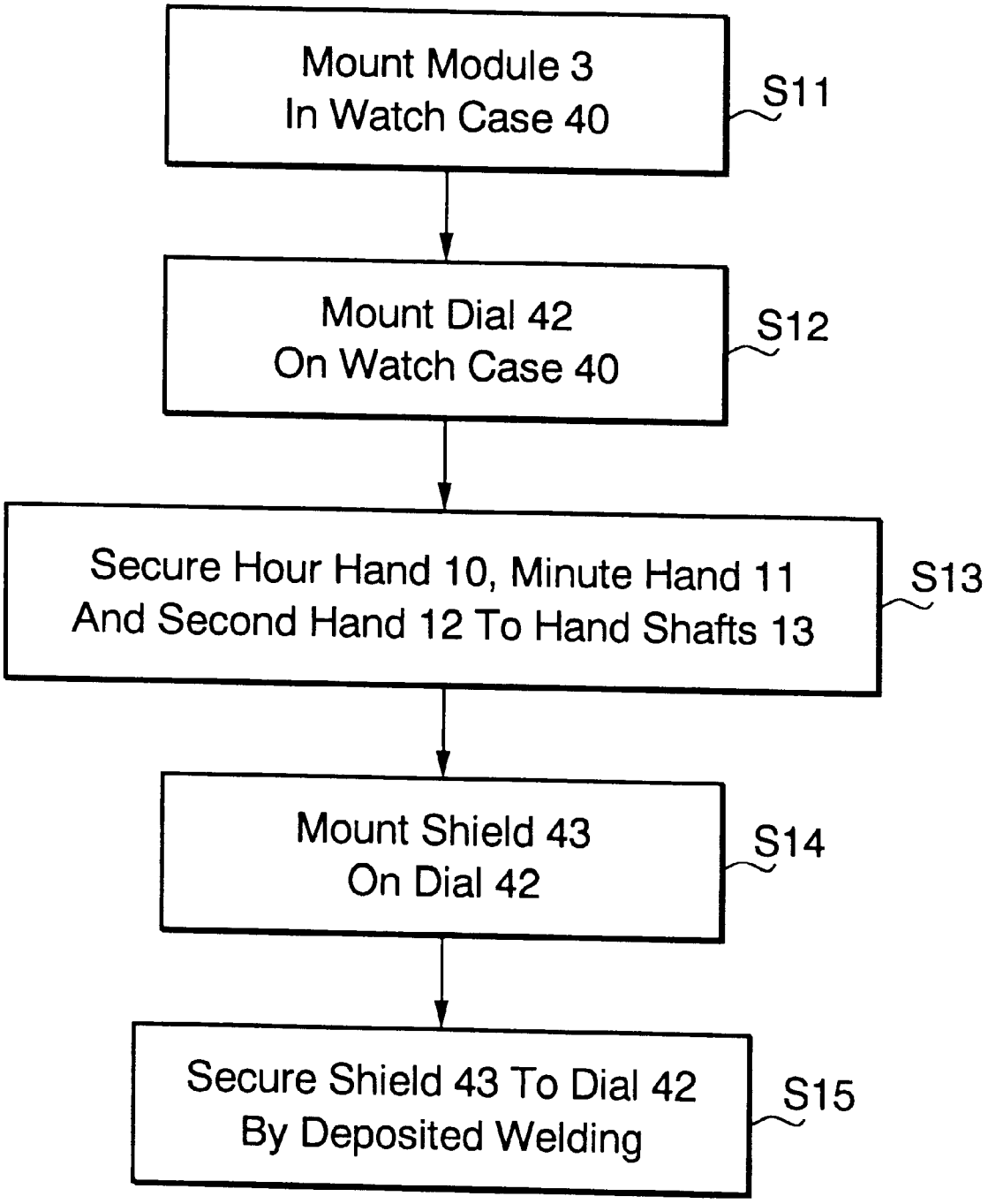
FIG. 9 is a flowchart showing a method for assembling of the watch of FIG. 7.

The assembling of the watch will be described with reference to the flowchart of FIG. 9.

At a step S11, the module 3 is mounted in the recess 40*e* of the watch case 40. At a step S12, the dial 42 is mounted on the watch case 40 and the module 3 so as to engage the positioning perforations 42*b* with the positioning projections 41. At a step S13, the hands 10, 11 and 12 are secured to the hand shafts 13. At a step S14, the shield 43 is mounted on the dial 42 corresponding to the positioning perforations 42*b*. At a step S15, the shield 43 is secured to the watch case 40 by deposited welding. The melting portion 44 of the projection 41 is melted, and the groove 45 formed on the periphery of the shield 43 is filled with molten material. Thus, the watch case 40 and the shield 43 are fixed to each other.

Figure 10:
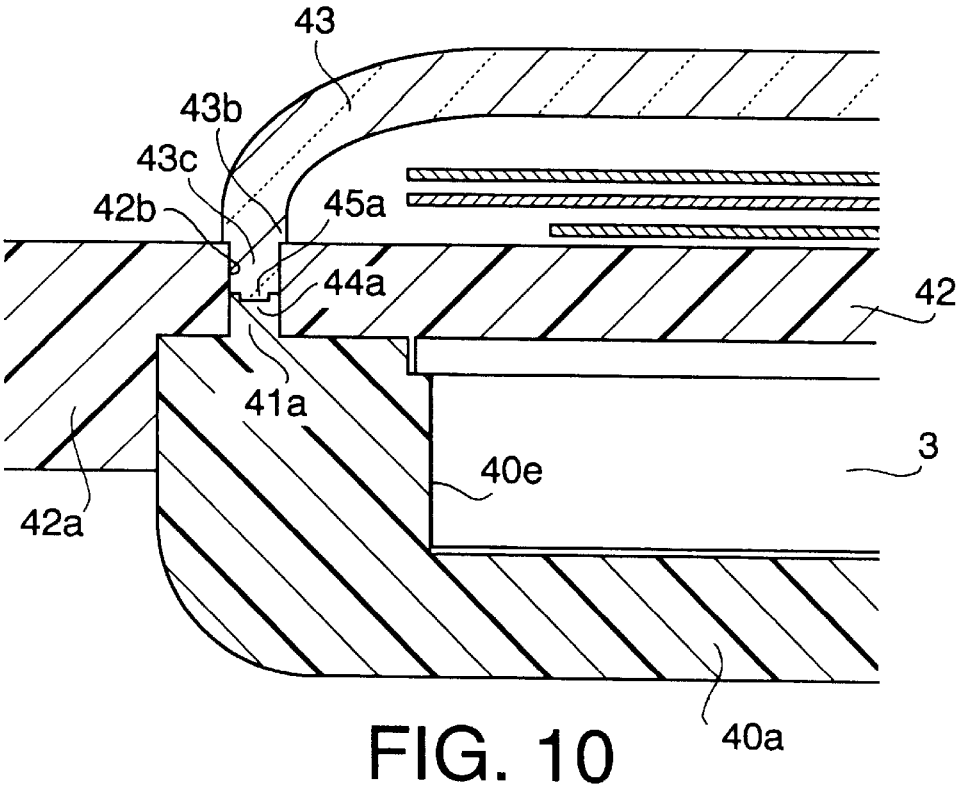
FIG. 10 is a sectional view showing a fourth embodiment.

FIG. 10 shows a fourth embodiment of the present invention. Structures which are the same as the third embodiment are identified with the same reference numerals as in FIG. 7.

A watch case 40*a* has a plurality of positioning projections 41*a* inserted in the positioning perforations 42*b* of the dial 42. The projection 41*a* has a height of half of the height of the perforation 42*b*. A groove 44*a* is formed on an upper portion of the projection 41*a*. The shield 43 has a plurality of legs 43*c* provided on the periphery corresponding to the positioning perforations 42*b*. The leg 43*c* also has a height of half of the height of the perforation 42*b*, and has a melting portion 45*a* formed on an end corresponding to the groove 44*a* of the projection 41*a*. A diameter of the leg 43*c* is smaller than the thickness of the shield 43 so as to form a shoulder 43*b* at a root of the leg 43*c*.

The watch is assembled in the same manner as in the third embodiment. Namely, the dial 42 is mounted on the watch case 40*a* having the module 3, engaging each projection 41*a* with the corresponding perforation 42*b*. The leg 43*c* of the shield 43 is inserted into the positioning perforation 42*b* and engaged with the end of the projection 41*a*, while the shoulder 43*b* is abutted on the surface of the dial 42. By deposited welding, the melting portion 45*a* of the leg 43*c* is melted and the groove 44*a* of the projection 41*a* is filled with molten material. Thus, the watch case 40*a* is secured to the dial 43.

Figure 11:
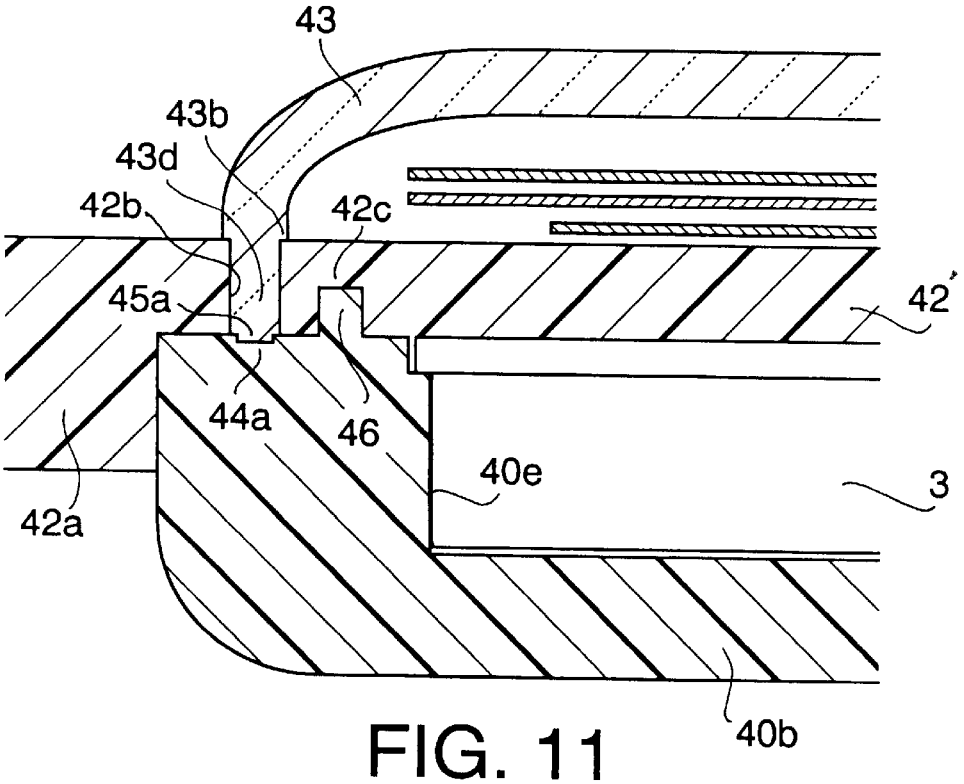
FIG. 11 is a sectional view showing a fifth embodiment.

FIG. 11 shows a fifth embodiment of the present invention. Structures which are the same as the fourth embodiment are identified with the same reference numerals as in FIG. 10.

A watch case 40*b* has a plurality of positioning projections 46. A dial 42' has a plurality of positioning holes 42*c* corresponding to the projections 46. The shield 43 has a plurality of legs 43*d*, each of which has the melting portion 45*a* inserted into the positioning perforations 42*b*, and each of which has the shoulder 43*b*. The grooves 44*a* are formed on the watch case 40*b* corresponding to the positioning perforations 42*b* of the dial 42'.

The dial 42' is mounted on the watch case 40*b* and the hole 42*c* is engaged with the projection 46. The leg 43*d* of the shield 43 is inserted into the perforation 42*b* and engaged with the groove 44*a* of the watch case, while the shoulder 43*b* is abutted on the surface of the dial 42'. By deposited welding, the groove 44*a* of the watch case 40*b* is filled with the molten material of the leg 43*d* of the shield 43, thereby fixing the watch case to the shield.

In the latter embodiment, it is not necessary to engage the positioning perforation 42*b* with the leg 43*d* with accuracy, since the dial 42'is positioned by the projection 46.

Figure 12:
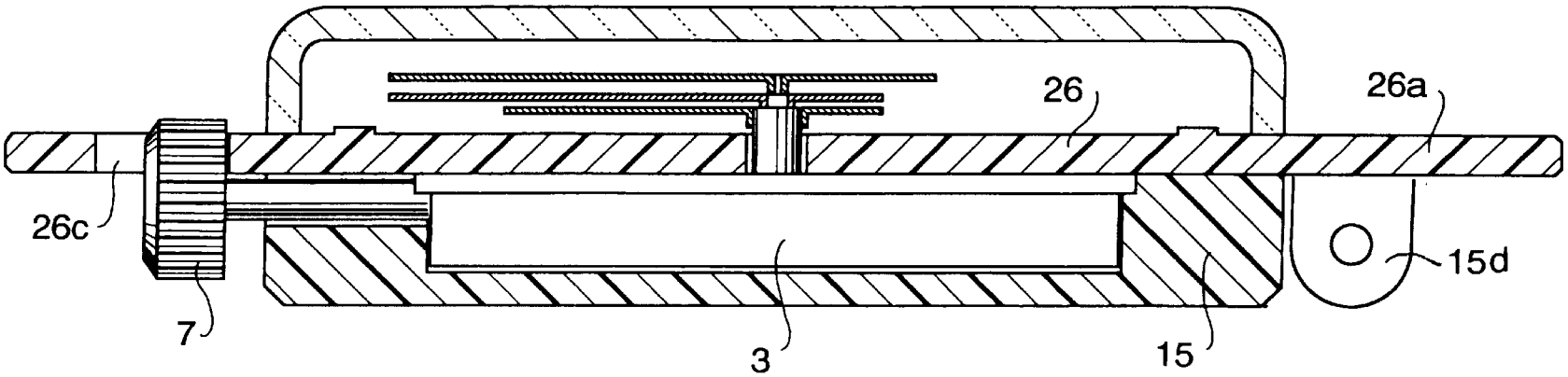
FIG. 12 is a sectional view showing a sixth embodiment.

FIG. 12 shows a sixth embodiment of the present invention. In the embodiment, a pair of band connecting portions 15*d* are secured to the underside of the outer extending portion 26*a* of the dial 26. The other structure is the same as the watch of FIG. 6.

Since the band connecting portions 15*a* are secured to the outer extending portion 26*a*, the extending portion is prevented from being detached from the watch case 15, even if the outer extending portion 26 strikes other things.

While the invention has been described in conjunction with preferred specific embodiment thereof, it will be understood that this description is intended to illustrate and not limit the scope of the invention, which is defined by the following claims.

What is claimed is:

1. A structure of a watch comprising:

a watch case with an inner recess;

a module mounted in the inner recess of the watch case;

an irregular shaped dial secured to the watch case;

said dial including a portion extending radially outward from the watch case so as to correspond to a predetermined configuration;

hands disposed above the dial and operatively connected to the module;

a picture on the dial, said picture having a shape and continuous pattern covering said predetermined configuration of the dial;

a shield secured to a central portion of the dial; and a pair of band connecting portions provided at each side of the watch, the band connecting portions being secured to the dial.

2. The structure according to claim 1 wherein the band connecting portions are secured to an underside of the dial.

3. The structure according to claim 1 wherein the shield is secured to the dial by welding.

4. The structure according to claim 1 wherein the extending portion covers a crown of the watch.

5. The structure according to claim 1 wherein the watch case, the dial, and the shield are made of plastic.

6. The structure according to claim 1 wherein the dial is welded to the watch case and the shield is welded to the dial.

7. The structure according to claim 4 wherein the extending portion has a recess at the underside thereof for receiving a part of the crown.

8. The structure according to claim 4 wherein the extending portion has a notch in which a part of the crown is inserted.

* * * * *